US005496036A

United States Patent [19]

Chester

[11] Patent Number: 5,496,036

[45] Date of Patent: Mar. 5, 1996

[54] FOOTBALL CARD BOARDGAME

[76] Inventor: Keith D. Chester, 1009 Cherrywood, Garland, Tex. 75040

[21] Appl. No.: 489,612

[22] Filed: Jun. 12, 1995

[51] Int. Cl.[6] ..... A63F 3/00

[52] U.S. Cl. ..... 273/247

[58] Field of Search ..... 273/242, 243, 273/244, 247, 240, 259, 94

[56] References Cited

U.S. PATENT DOCUMENTS

| | | | |
|---|---|---|---|
| 543,463 | 7/1895 | Brown | 273/247 |
| 3,887,191 | 6/1975 | Lucas | 273/247 |
| 4,168,834 | 9/1979 | Mangiarelli | 273/247 |
| 4,773,650 | 9/1988 | Doughty | 273/247 |
| 4,989,879 | 2/1991 | Nigh | 273/247 |
| 5,039,107 | 8/1991 | Jackson | 273/247 X |
| 5,217,229 | 6/1993 | Jaime | 273/247 |
| 5,423,550 | 6/1995 | Guthrie | 273/247 |

FOREIGN PATENT DOCUMENTS

| | | | |
|---|---|---|---|
| 2187967 | 9/1987 | United Kingdom | 273/247 |
| 2201352 | 9/1988 | United Kingdom | 273/247 |

*Primary Examiner*—William E. Stoll
*Attorney, Agent, or Firm*—T. D. Copeland

[57] ABSTRACT

The Football Card Boardgame is designed with two football fields that have a dry erase board surface. The players will have their own playing field going the opposite direction of each other. Each player will have three offensive possessions per quarter. Using color markers, players will mark the progression of each of their possessions. An offensive line marker with the picture of a player for each position is used to mark the spot of the ball. The game includes a pair of dice, a standard die, and a yard quantity die, a pack of fifty-four shuffleable cards with a sport card front and star sheets.

10 Claims, 3 Drawing Sheets

| TEAMS | 1 | 2 | 3 | 4 | FINAL |
|---|---|---|---|---|---|
| SAN DIEGO | | | | | |
| SAN FRANCISCO | | | | | |

| CATEGORY | TEAM | FIRST HALF | SECOND HALF | TOTAL |
|---|---|---|---|---|
| YARDS GAINED | S.D. | | | |
| | S.F. | | | |
| SACKS AND YARDS LOST | S.D. | | | |
| | S.F. | | | |
| FUMBLES AND RETURN YARDS | S.D. | | | |
| | S.F. | | | |
| INTERCEPTION RETURN YARDS | S.D. | | | |
| | S.F. | | | |
| KICKOFF RETURN YARDS | S.D. | | | |
| | S.F. | | | |
| PUNT RETURN YARDS | S.D. | | | |
| | S.F. | | | |
| FIELD GOALS MADE AND YARDS | S.D. | | | |
| | S.F. | | | |

BLUE MARKER
~ RED MARKER
* BLACK MARKER

FOOTBALL CARD BOARDGAME

BACKGROUND OF THE INVENTION

1. Field of the Invention

The invention relates generally to board games that correspond to actual sporting events, e.g., professional football games, that are played with published football cards, and one regular die, and one modified die to correspond to actual playing conditions.

2. Prior Art

There are numerous sport game board patents, of which the following are examples:

U.S. Pat. No. 5,158,301, issued Oct. 27, 1992, to Joseph J. Martukovich, Jr., is for a simulated football game apparatus which includes a game board depicting a standard football playing field, and a game piece resembling a football that is movable on the game board to indicate the position of the football on the playing field; and including two sets of playing cards, and a chance number selector.

U.S. Patent No. 5,221,084, issued Jun. 22, 1993, to Tom Stelmach, discloses a football board game that includes a game board on which is depicted a simulated football playing field, in the form of an elongated graph of squares, with end zones at opposite ends.

U.S. Pat. No. 5,221,091, issued Jun. 22, 1993, to Robert A . Gallegos, et al, discloses a board game in which players acquire, then sell sports cards; each player being represented by a game piece which traverses a common path on the board, the distance of travel being determined by the throw of a die.

U.S. Pat. No. 5,356,152, issued Oct. 18, 1994, to Kevin Currey, discloses a game in which participants simulate plays in a football game using two sets of pegs to represent various players on each of the two football teams that oppose each other in this game.

SUMMERY OF THE INVENTION

This boardgame is designed with two adjacent and joined football fields that have a dry erase board surface.

Each team (contestant) has its own field going in the opposite direction of each other. Each team will have three offensive possessions per quarter. Using color markers, players will mark the progression of each of their possessions. An offensive line marker (which may be an assemblage of commercial football cards) with the picture of a player for each position from tackle to tackle is used to mark the spot of the ball. The game includes a pair of dice, a standard and yard indicating die, a pack of fifty-four shuffleable cards with a statistical sport card front side (depicting a proffessional football player) with a "situation" number in the upper right corner of the face side, and a goal post decoration on the back side, as noted in FIG. 4.

In addition to providing training in math for young players (contestants), this game will assist in learning the rules of regular football, and is a vehicle for improving lettering skills.

DESCRIPTION OF THE PREFERRED EMBODIMENT

Figures 1, 2:
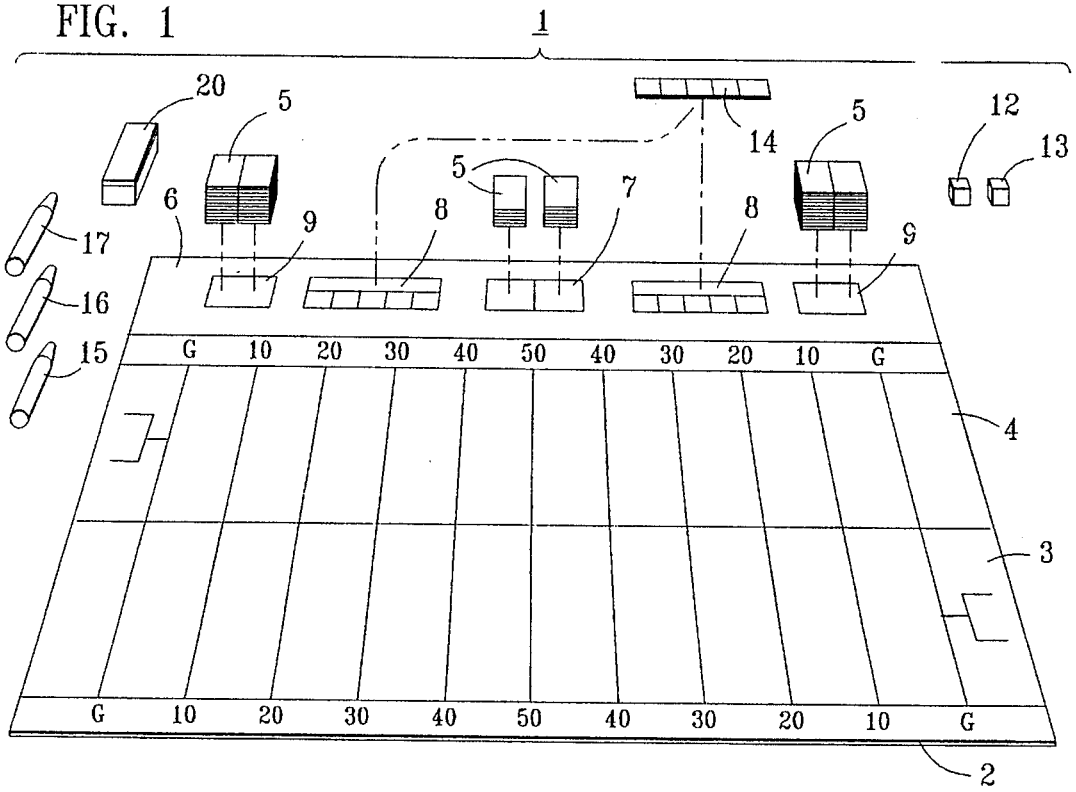
FIG. 1 is a perspective view of the boardgame and its component parts.
FIG. 2 is a plan view of the scorecard that is used with this game, to not only keep tab on the teams' scores, but also to keep a separate record of the statistical performance of each team during the game.
Figure 3:
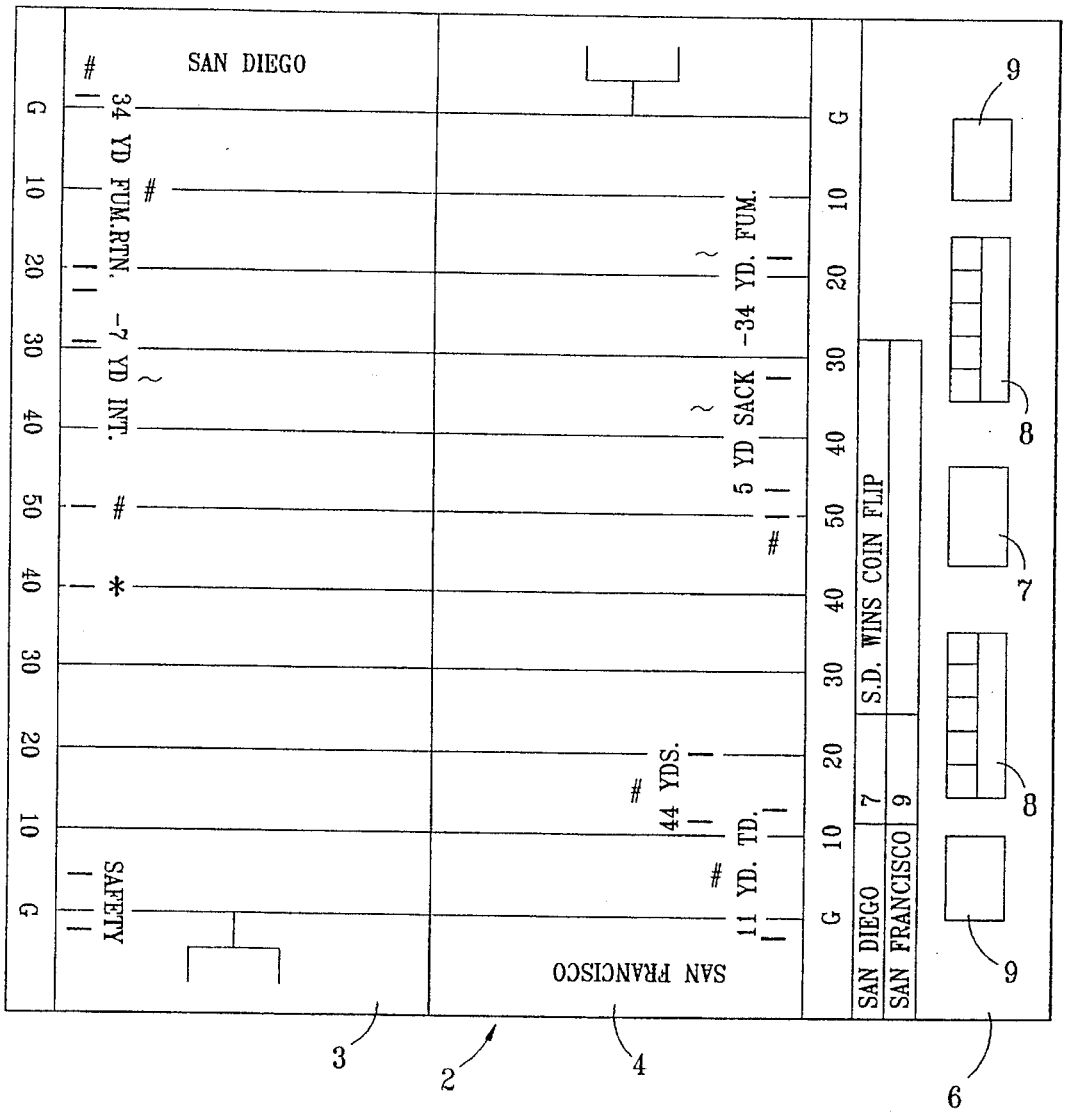
FIG. 3 is a plan view of the field of play on the dry erasable board of this game, showing additional indicia that is erasable, and is to be changed as the game progresses.
Figure 4:
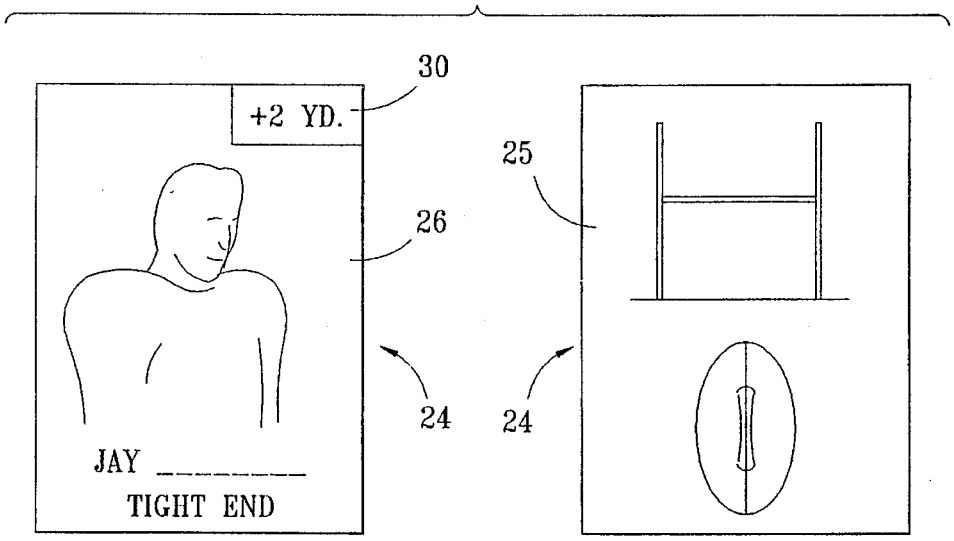
FIG. 4 is a plan view the front and back side of of a typical action card used with the game of this invention.
Figure 5:
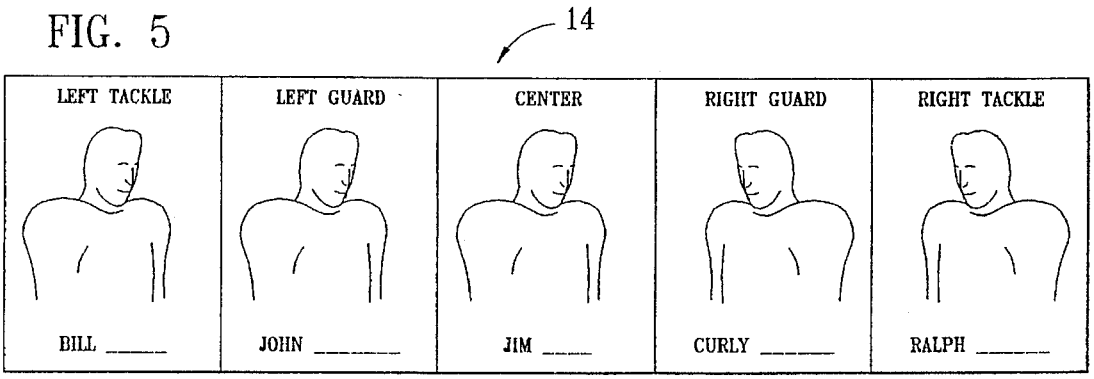
FIG. 5 is a plan view of a typical player spread card that makes up the inside front line of one of the opposing teams in this game.
Figure 6:
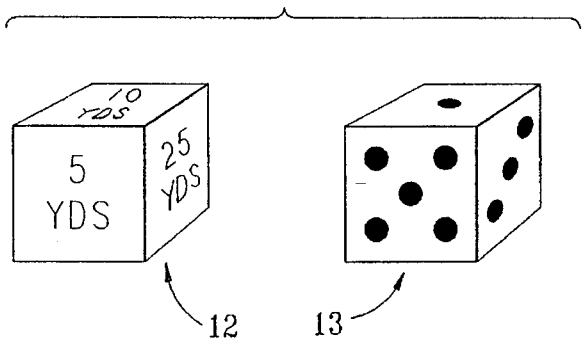
FIG. 6 is a perspective view of the dice used with this game.

Referring now more particularly to FIG. 1, it will be observed that the complete package of this boardgame 1, comprises a game board 2, on which is laid out two separate but joined football fields 3 and 4, to be utilized by the contestants playing this boardgame 1. Along one sideline of the board 2, each opponent has a bench 5 located at opposite ends of the sideline area 6. Midway between the benches is located the huddle area 7, and between each bench and the huddle is located a scorecard 8. During play, each bench contains initially, one set of action cards 9, which are transferred to the huddle area 7, after each card 9 is used to generate a play or action in the game.

FIG. 2 represents a single scoresheet that may also be on a markable and erasable pad to tally up the final score and final stats.

The remaining components used in this game comprise: a yard die 12, which notes a different yardage on each of its six sides, i.e., 5, 7, 15, 20, 30 and 50 yards, and a second regular die 13, with its spots 1 thru 6, and an offensive yard marker 14, comprising five photos of prominent football players in the respective position that each would be playing in the inside offensive line off professional football, i.e., two tackles, two guards, and one center; black, blue and red markers 15, 16 & 17 to signify respectively, the yards needed for a first down, the yards actually gained on a play, and the yards lost on a play. Since these colors will not show up in a black and white drawing, as used herein, the se colored marks are noted in these patent drawings by the following icons:

* is lettering by black marker; # or blue; for red.

and an eraser 20 to remove the markings on this erasable board 2, after each play as required.

This boardgame is played between two opponents, utilizing the below noted rules. Since the real world professional football is divided into two leagues, which permits the winners of each league to meet in the Super Bowl to climax the season, so likewise does this boardgame have two sets of Rules to correspond to the two conferences, i.e., The National Football Conference (NFC), and the American Football Conference (AFC), alternatively, the East and West Conference, EFC and WFC.

The NFC Game Rules are:

1. Flip a coin to determine who goes first.
2. Roll the dice for kickoff return. With the black marker, mark the spot needed for a first down.
3. The offensive player will roll the dice. The defensive player will choose a card of or between the number showing on the die. For example, the regular die indicates 3, so the defensive player can choose either the first, second or third card from the face down cards of a stack. When choosing a card, keep it face down until you pick the card you want. The cards that weren't chosen will be placed at the bottom of the stack on the huddle space.

4. To determine yards gained or lost, add or substract the number on the face of the selected card from the number on the yard die. After yards have been determined, place the card face up on the offensive team's bench in stack 10. With the blue marker mark the position to indicate yards gained.
5. If a sack card is drawn, disregard the yard die and subtract the number on the card from the spot of the ball. With the red marker, mark position and indicate yards lost.
6. If a fumble or interception card is drawn, advance the ball position line according to the yard die. Then the defensive player will roll the dice and spot the ball position according to the yard die. With the red marker, mark the spot of the turnover.
7. Extra points (12 yards) and field goals (40 yards and in) are determined by number on yard die. To punt, roll dice and multiply the number on the yard die, except for the fifty, by two. Only punts beyond the offensive player forty yard line can be returned.
8. The cards in the huddle will be played until there are less than five cards left. Then reshuffle cards to complete the game.
9. A quarter consists of both teams receiving three offensive possessions. A defensive touchdown equals a possession. If the games goes into overtime, redo coin flip, but continue playing the cards that are remaining in the huddle stack 7.
10. If a touchdown card is drawn, disregard the yard die; it is a touchdown for the offense.
11. If a safety occurs giving a player a three-to-one edge in a quarter, the opposing player will have another possession to end the quarter three possessions to two.
12. If the half or game ends on an interception or fumble, the defensive player will roll for a return.
13. To figure yards gained, add up your offensive yards, then substract negative yards, sack, interception and fumble return yards of your opponent.

The AFC Game Rules are:

1. Shuffle and distribute all the cards equally between the two players. Without looking at, or organizing the cards, collect and place them face down on your bench.
2. The offensive player will roll the dice. The defensive player will play the card on his bench in the order they are in. After yard has been determined, place card in the huddle.
3. Follow the same rules and direction hereafter, as given for the NFC, herein before.

In the following example, the teams playing this game are San Diego (SD) and San Francisco (SF), or alternately, California (CA) & Texas (TX), and play markers will be used to print the yards for 1st down, yards actually gained, and yards lost directly on board 2. The quantity and text on the complete set of action cards 9 are as follows:

| CARDS BREAKDOWN | | |
|---|---|---|
| 2 Tight Ends | +2 & +4 yds. | |
| 3 Quarterbacks | +3, +6 & +9 yds. | |
| 4 Wide Receivers | +6, +8, +10 & Touchdown | |
| 5 Running Backs | +4, +5, +6, +10 & Touchdown | |
| 8 Tackles | 4 - 5 yd. Sack | 4 - −9 yds. |
| 8 Ends | 4 - 10 yd. Sack | 4 - −8 yds. |
| 8 Linebackers | 4 - Fumble | 4 - −7 yds. |
| 8 Cornerbacks | 4 - Interception | 4 - −6 yds. |

-continued

| CARDS BREAKDOWN | |
|---|---|
| 8 Safeties | 8 - Incomplete |

A typical summation of the play action for one quarter of a game would go as follows:

FIRST QUARTER PLAY

Kickoff return 50 yds.
SD ball on the 50 first possession.
Yard die 30, Number die 3, 2nd card chosen Interception.
SF interception on the 20.
Interception return 7 yds., ball on 27.
SF ball on SD 27, SF first possession.
Yard die 7, Number die 3, 1st card chosen, Fumble.
SD recover fumble on SF 34.
Fumble return 34 yds, TD, SD second possession.
Defense rolled 50 on Yard die.
Kickoff return 50 yds.
SF ball on the 50, SF second possession.
Yard die 5, Number die 4, 3rd card chosen, 5 yd. Sack.
SF ball on the SD 45.
Yard die 50, Number die 5, 5th card chosen, −6 yds.
SF ball on own 11.
Yard die 20, Number die 1, 1st card chose, −8 yds.
SF 11 yd. TD.
Kickoff return 5 yds.
SD ball on SF 5, SD third possession.
Yard die 5, Number die 4, 4th card chosen, Incomplete.
SD ball on SF 5.
Yard die 15, Number die 3, 2nd card chosen, 10 yd. Sack.
SF 2 point safety, SF third possession, end of 1st quarter.

Having thus described the instant invention,

1. A football game apparatus comprising, in combination:

a. a markable erasable game board having a pair of adjacent football fields lengthwise thereon, b. a slidable offensive yard marker for each field to identify the position of the football on said field, c. a set of different colored markers to indicate respectively, the football position before the ball is snapped, and the gain or loss position of the football after each play, d. an equal number of action cards for each game player, e. a pair of dice, wherein one die is regular and includes numbered dots thereon, and the second die designates numbers of yards, f. a set of rules requiring one player to roll said dice, and g. the other player to turn his top card over, h. the resulting game action being the sum or difference of the numbers shown on the action card and on the yard die, and i. a score chart for identifying the game winner after a number of offensive plays have occurred for each player in each game quarter.

2. A game apparatus as in claim 1, wherein said offensive line marker includes pictures of established football players.

3. A football game apparatus, comprising, in combination:

a. a markable erasable game board having a pair of adjacent football fields on the same board for one contestant's team each, b. a slidable offensive yard marker for each field to identify the position of the football on said field, c. a set of markers to indicate the starting and finishing position of the football with each play, d. a number of action cards for at least one contestant, e. a pair of dice for at least one of the contestants, f. a set of rules for this game requiring one contestant to roll the dice, and g. one contestant to turn a selected one of his action cards, h. the resulting game action being the sum or difference of the numbers shown on the action card selected and on the yard die, i. and charts for disclosing the scores and statistics for each team.

4. A game apparatus as in claim 3, wherein said offensive line marker includes pictures of established football players.

5. A game apparatus as in claim 3, wherein said game rules require that one contestant roll the dice and the other contestant turn an action card determined by the number on the regular die.

6. A game apparatus as in claim 3, wherein said game rules require that one contestant roll the dice and the other contestant turn an action card of his selection within the number on the regular die.

7. A method of playing a football boardgame, involving two contestants and teams, two separated playing fields on a markable erasable game board including bench and huddle areas, a pair of dice, one regular and the other having six different yardage designations, at least one stack of action/situation cards, a set of markers, and an offensive line locater comprised of football cards, comprising in combination, the steps of:

a. one contestant rolling a pair of dice, one die to indicate yardage, and the other die to indicate the number of cards the other contestant may make his selection of one card per play from;

b. said other contestant selecting a card from a stack of face down cards wherein the face indicates a football situation, that is added or subtracted from the yard die reading, if appropriate;

c. said one contestant moving its offensive line locater to position determined by situation card and/or yardage die;

d. said one contestant continuing to roll the dice, and said other contestant continuing to turn situation cards until said one contestant's team makes a touchdown, or loses control of the football.

8. A method oil playing a football boardgame, as in claim 7, wherein said markers are used to indicate results of game actions directly on said erasable game board.

9. A method of playing a football boardgame, as in claim 7, wherein said stack of situation cards are initially located in at least one bench area, and wherein said situation cards after use are transferred to said huddle area.

10. A method of playing a football boardgame, as in claim 7, wherein said set of markers comprise several colors to correspond to football situations.

* * * * *